US011852046B1

(12) United States Patent
Kwon et al.

(10) Patent No.: US 11,852,046 B1
(45) Date of Patent: Dec. 26, 2023

(54) CONTINUOUS VARIABLE VALVE DURATION APPARATUS AND ENGINE PROVIDED WITH THE SAME

(71) Applicants: HYUNDAI MOTOR COMPANY, Seoul (KR); KIA CORPORATION, Seoul (KR)

(72) Inventors: Kiyoung Kwon, Yongin-si (KR); Jinyoung Jung, Gunpo-si (KR); You Sang Son, Suwon-si (KR); Back Sik Kim, Osan-si (KR); Dongwon Jung, Gwacheon-si (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/983,748

(22) Filed: Nov. 9, 2022

(30) Foreign Application Priority Data

Jun. 29, 2022 (KR) ..... 10-2022-0079670

(51) Int. Cl.
*F01L 1/047* (2006.01)
*F02D 13/02* (2006.01)
*F01L 1/12* (2006.01)

(52) U.S. Cl.
CPC ..... *F01L 1/047* (2013.01); *F01L 1/12* (2013.01); *F02D 13/0207* (2013.01); *F01L 2001/0473* (2013.01); *F01L 2305/00* (2020.05)

(58) Field of Classification Search
CPC ..... F02D 13/0207; F01L 1/047; F01L 1/12; F01L 2305/00; F01L 13/0015; F01L 2001/0473; F01L 1/356; F01L 2013/103; F01L 1/0532; F01L 2001/0476; F01L 1/053
See application file for complete search history.

(56) References Cited

U.S. PATENT DOCUMENTS

| | | | | |
|---|---|---|---|---|
| 8,813,704 | B2 | 8/2014 | Kim et al. | |
| 9,512,748 | B2 | 12/2016 | Kim et al. | |
| 9,574,467 | B2 | 2/2017 | Ha | |
| 9,869,215 | B2 | 1/2018 | Son et al. | |
| 2017/0074129 | A1* | 3/2017 | Son | F01L 13/0026 |
| 2017/0082036 | A1* | 3/2017 | Kwon | F02D 13/0211 |
| 2021/0381404 | A1* | 12/2021 | Kim | F01L 13/0015 |

FOREIGN PATENT DOCUMENTS

| | | | | |
|---|---|---|---|---|
| CN | 112228230 A | * | 1/2021 | F01L 1/053 |
| KR | 2021-0008598 A | | 1/2021 | |

* cited by examiner

*Primary Examiner* — Wesley G Harris
(74) *Attorney, Agent, or Firm* — McDonnell Boehnen Hulbert & Berghoff LLP

(57) ABSTRACT

A continuous variable valve duration apparatus includes a camshaft, a cam unit on which a cam is formed and the camshaft is inserted, a guide bracket of which an upper guide boss is formed, an inner wheel transmitting the rotation of the camshaft to the cam unit, a wheel housing of which a guide shaft having a guide thread formed thereto to be movably inserted into the upper guide boss is formed thereto, and of which a tail guide guiding the relative movement of the guide bracket is formed thereto, and the wheel housing into which the inner wheel is rotatably inserted, a worm wheel of which an inner thread engaged with the guide thread is formed on inside thereof and of which an outer thread is formed on outside thereof, and a tolerance adjusting pin inserted into the tolerance adjusting portion.

18 Claims, 18 Drawing Sheets

CONTINUOUS VARIABLE VALVE DURATION APPARATUS AND ENGINE PROVIDED WITH THE SAME

CROSS REFERENCE TO RELATED APPLICATIONS

This application claims priority to and the benefit of Korean Patent Application No. 10-2022-0079670 filed in the Korean Intellectual Property Office on Jun. 29, 2022, the entire contents of which are incorporated herein by reference.

BACKGROUND

(a) Field

The present disclosure relates to a continuous variable valve duration apparatus and an engine provided with the same. More particularly, the present disclosure relates to a continuous variable valve duration apparatus and an engine provided with the same which may vary opening duration of a valve according to operation conditions of an engine with a simple construction and reduce noise and vibration by easy tolerance control.

(b) Description of the Related Art

An internal combustion engine generates power by combusting fuel in a combustion chamber in an air media drawn into the chamber. Intake valves are operated by a camshaft in order to intake the air, and the air is drawn into the combustion chamber while the intake valves are open. Furthermore, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, various researches, such as designing of a plurality of cams and a continuous variable valve lift (CVVL) that can change valve lift according to engine speed, have been undertaken.

Also, to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

And, also, CVVD (Continuous Variable Valve Duration) technology has been developed by maintaining the lift of the valve constant and controlling the opening duration of the valve.

However, these products may have differences in assemble quality depending on the manufacturing state of each part, and tolerances of the finished product may occur, thereby causing noise and vibration.

The above information disclosed in this Background section is only for enhancement of understanding of the background of the disclosure, and therefore it may contain information that does not form the prior art that is already known in this country to a person of ordinary skill in the art.

SUMMARY

The present disclosure has been made in an effort to provide a continuous variable valve duration apparatus and an engine provided with the same which may vary opening duration of a valve according to operation conditions of an engine with a simple construction and reduce noise and vibration by easy tolerance control.

A continuous variable valve duration apparatus according to an exemplary embodiment of the present disclosure may include a camshaft, a cam unit on which a cam is formed and the camshaft is inserted into the cam unit, a guide bracket of which an upper guide boss is formed thereto, an inner wheel transmitting the rotation of the camshaft to the cam unit, a wheel housing of which a guide shaft having a guide thread formed thereto to be movably inserted into the upper guide boss is formed thereto, and of which a tail guide guiding the relative movement of the guide bracket is formed thereto, and the wheel housing into which the inner wheel is rotatably inserted, a worm wheel of which an inner thread engaged with the guide thread is formed on inside thereof and of which an outer thread is formed on outside thereof, a control shaft of which a control worm engaged with the outer thread is formed thereto, a tolerance adjusting portion formed to the guide bracket at a position corresponding to the tail guide, and a tolerance adjusting pin inserted into the tolerance adjusting portion.

The tail guide may be protruded to wrap around the guide bracket.

The guide bracket may include an upper guide bracket of which the upper guide boss into which the guide shaft is inserted is formed thereto, and a lower guide bracket of which a lower guide boss is formed thereto, and connected with the upper guide bracket.

The wheel housing may include a guide rod formed protruded to be inserted into the lower guide boss.

The tolerance adjusting portion may be formed on the lower guide bracket.

The tail guide may be formed in pairs in symmetrical positions to surround the guide bracket, and the tolerance adjusting pin may be mounted in pairs in corresponding positions on each of the tail guide.

The continuous variable valve duration apparatus according to an exemplary embodiment of the present disclosure may further include a thrust bearing mounted on the upper guide boss to support the worm wheel.

The continuous variable valve duration apparatus according to an exemplary embodiment of the present disclosure may further include a worm cap connected to the guide bracket to support the thrust bearing.

A control shaft hole supporting the control shaft may be formed in the guide bracket.

The continuous variable valve duration apparatus according to an exemplary embodiment of the present disclosure may further include a control shaft bearing mounted in the control shaft hole to support rotation of the control shaft.

The inner thread and the guide thread of the worm wheel may be trapezoidal threads.

First and second sliding holes may be formed to the inner wheel, and a cam slot may be formed to the cam unit. The continuous variable valve duration apparatus according to an exemplary embodiment of the present disclosure may further include a roller wheel connected to the camshaft and rotatably inserted into the first sliding hole, and a roller cam slidably inserted into the cam slot and rotatably inserted into the second sliding hole.

The roller cam may include a roller cam body slidably inserted into the cam slot, a cam head rotatably inserted into the second sliding hole, and a protrusion configured to prevent the roller cam from being removed.

The roller wheel may include a wheel body slidably connected to the camshaft, and a wheel head rotatably inserted into the first sliding hole.

The continuous variable valve duration apparatus according to an exemplary embodiment of the present disclosure may further include a camshaft oil hole formed within the camshaft along a longitudinal direction thereof, a body oil hole formed to the wheel body of the roller wheel and configured to communicate with the camshaft oil hole, and an oil groove formed to the wheel head of the roller wheel and configured to communicate with the body oil hole.

The cam unit may include a first cam portion and a second cam portion which are disposed corresponding to a cylinder and an adjacent cylinder respectively, and the inner wheel may include a first inner wheel and a second inner wheel configured to transmit the rotation of the camshaft to the first cam portion and the second cam portion respectively.

The first inner wheel and the second inner wheel may be connected rotatable to each other.

The continuous variable valve duration apparatus according to an exemplary embodiment of the present disclosure may further include first and second bearings disposed within the wheel housing and configured to support the first inner wheel and the second inner wheel respectively.

An engine according to an exemplary embodiment of the present disclosure may be provided with the continuous variable valve duration apparatus.

According to the continuous variable valve duration apparatus according to an exemplary embodiment of the present disclosure as described above, it is possible to adjust the duration of the valve according to the operation state of the engine with a simple configuration, and it is possible to reduce noise and vibration by easy tolerance control.

The composition of the continuous variable valve duration apparatus is relatively small, so the entire height of the valve train can be kept relatively low.

The continuous variable valve duration apparatus may be applied without excessive design change of the existing general engine, so productivity may be increased and production cost may be reduced.

DETAILED DESCRIPTION

Figure 1:
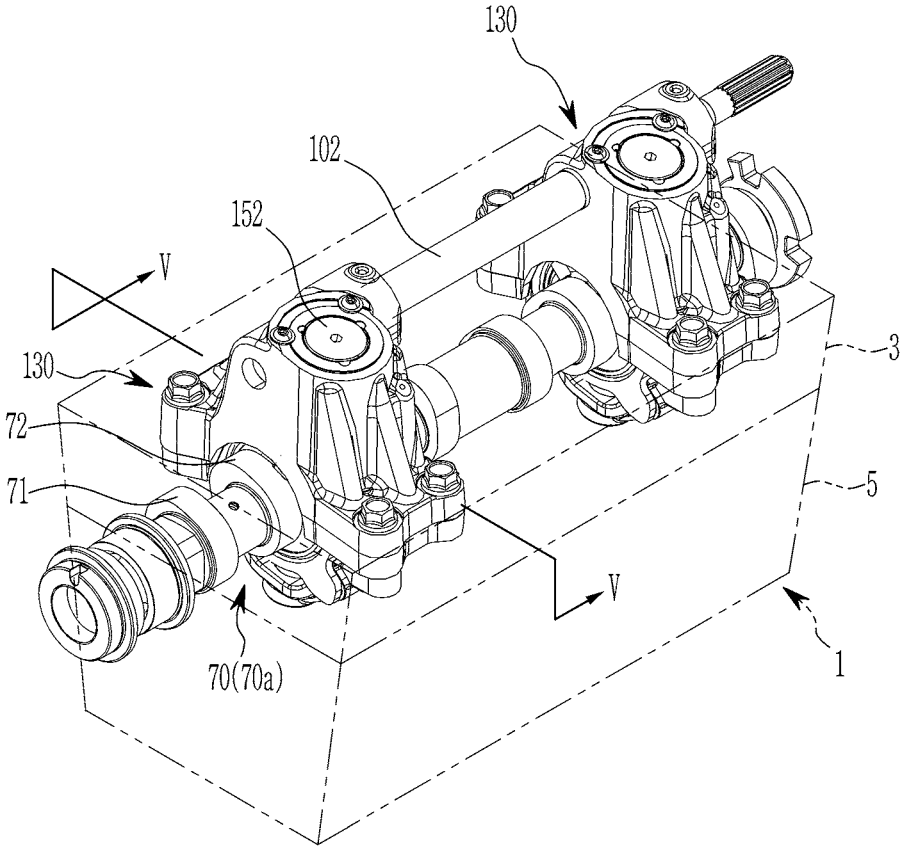
FIG. 1 is a perspective view of an engine provided with a continuous variable valve duration apparatus according to an exemplary embodiment of the present disclosure.

In the following detailed description, only certain exemplary embodiments of the present disclosure have been shown and described, simply by way of illustration.

As those skilled in the art would realize, the described embodiments may be modified in various different ways, all without departing from the spirit or scope of the present disclosure Parts marked with the same reference number throughout the specification mean the same constituent elements.

In the drawings, the thickness of layers, films, panels, regions, etc., are exaggerated for clarity.

Throughout the specification, when a part "includes" a certain element, it means that other elements may be further included, rather than excluding other elements, unless otherwise stated.

An exemplary embodiment of the present disclosure will hereinafter be described in detail with reference to the accompanying drawings.

Figure 2:
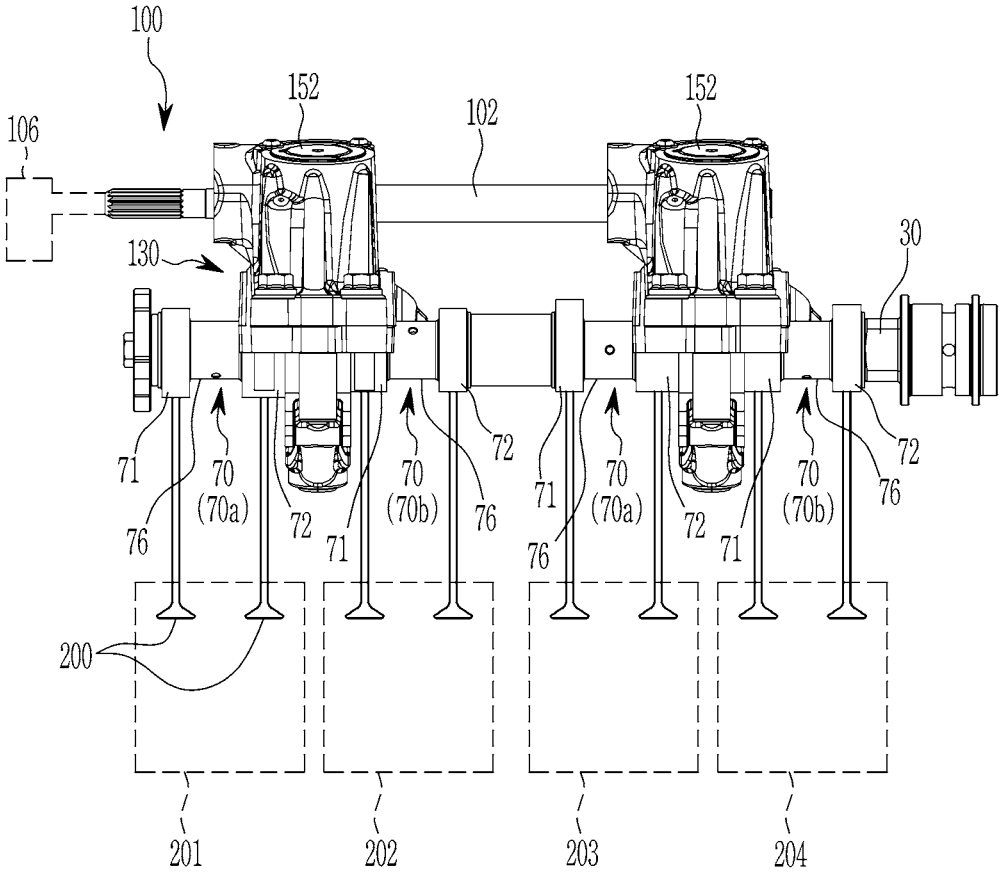
FIG. 2 is a side view of a continuous variable valve duration apparatus according to an exemplary embodiment of the present disclosure.

FIG. 1 is a perspective view of an engine provided with a continuous variable valve duration apparatus according to an exemplary embodiment of the present disclosure, and FIG. 2 is a side view of a continuous variable valve duration apparatus according to an exemplary embodiment of the present disclosure.

Figure 3:
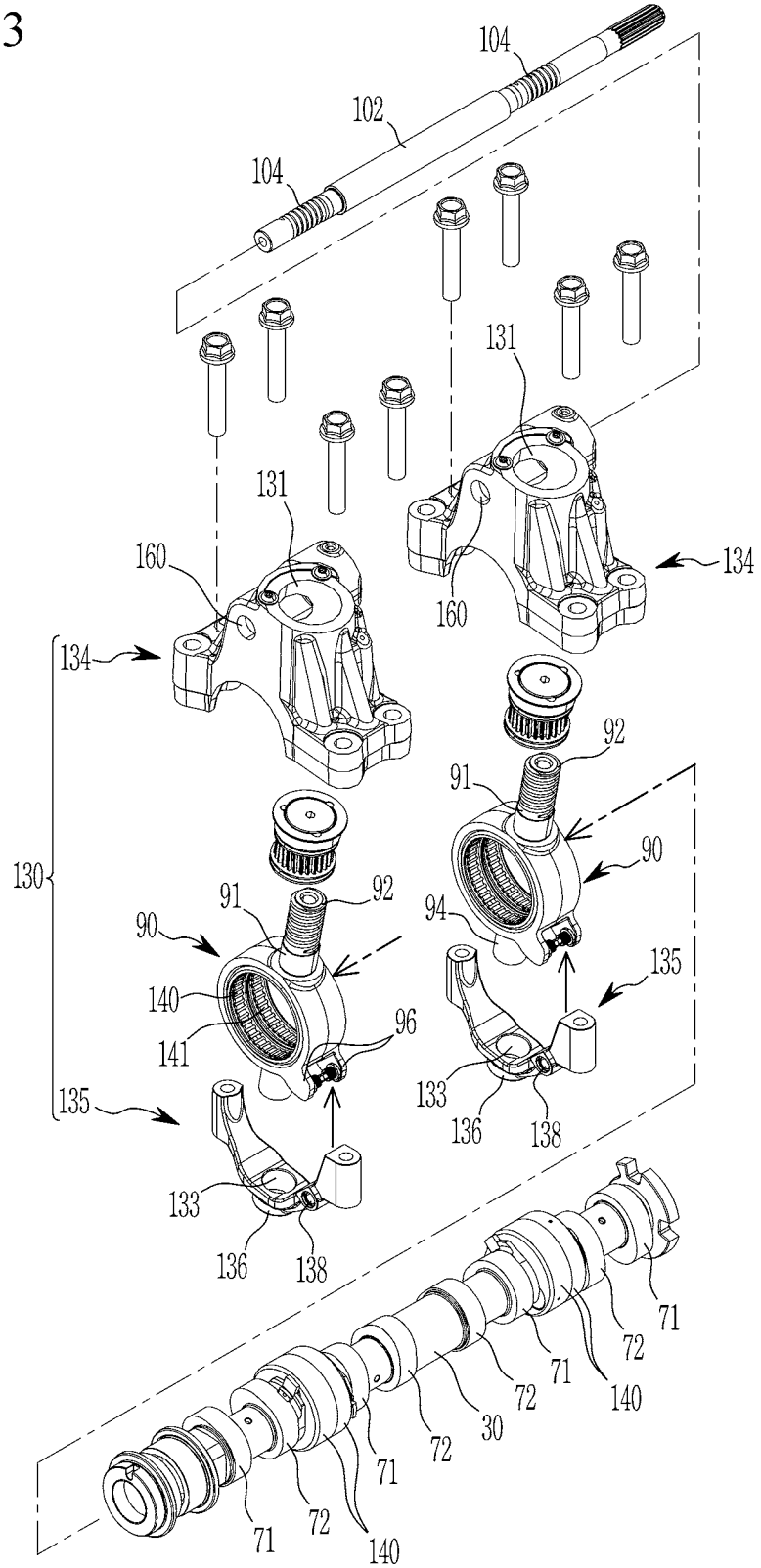
FIG. 3 is an exploded perspective view of a continuous variable valve duration apparatus according to an exemplary embodiment of the present disclosure.
Figure 4:
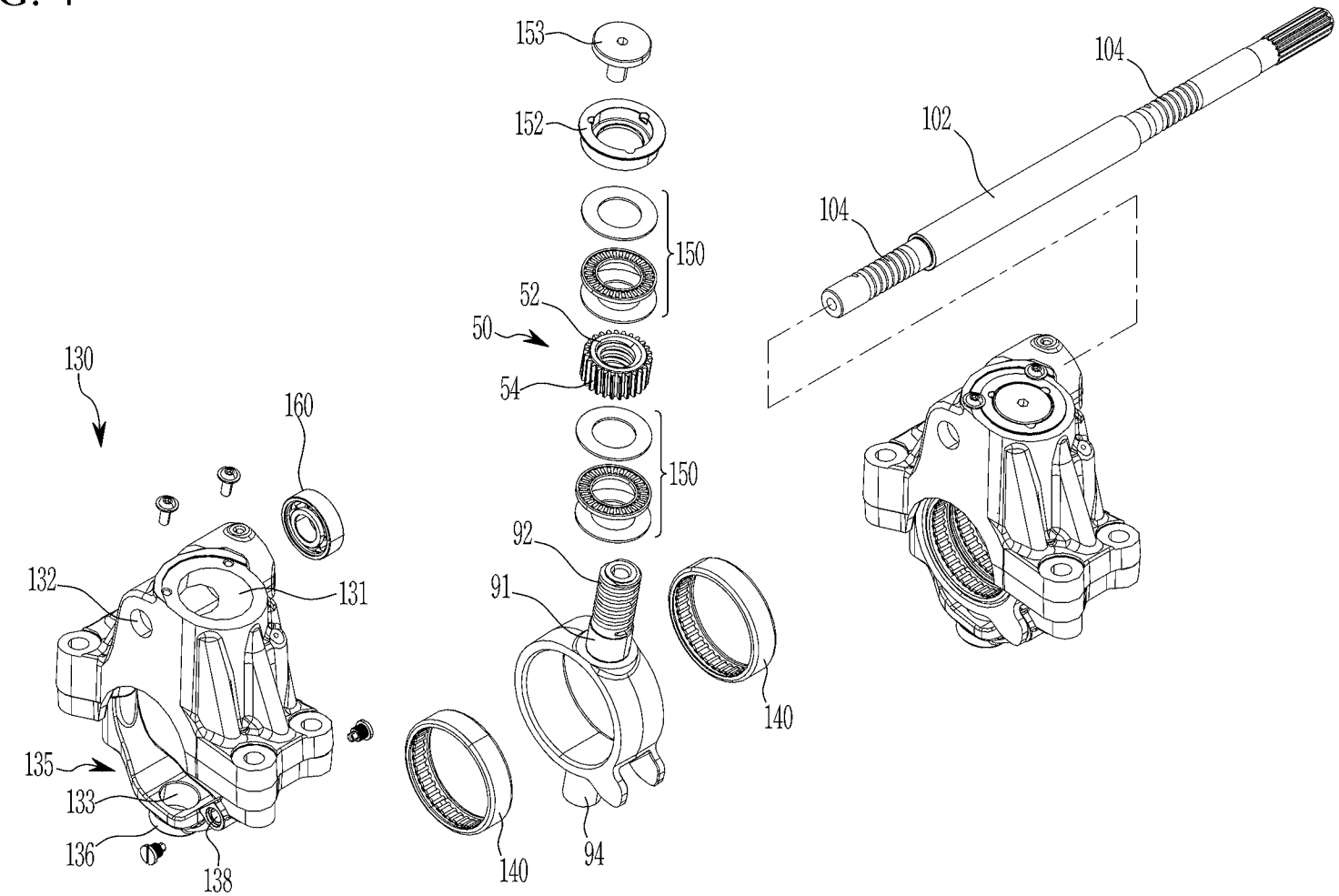
FIG. 4 is a partial perspective view of a continuous variable valve duration apparatus according to an exemplary embodiment of the present disclosure.

FIG. 3 is an exploded perspective view of a continuous variable valve duration apparatus according to an exemplary embodiment of the present disclosure, and FIG. 4 is a partial perspective view of a continuous variable valve duration apparatus according to an exemplary embodiment of the present disclosure.

Figure 5:
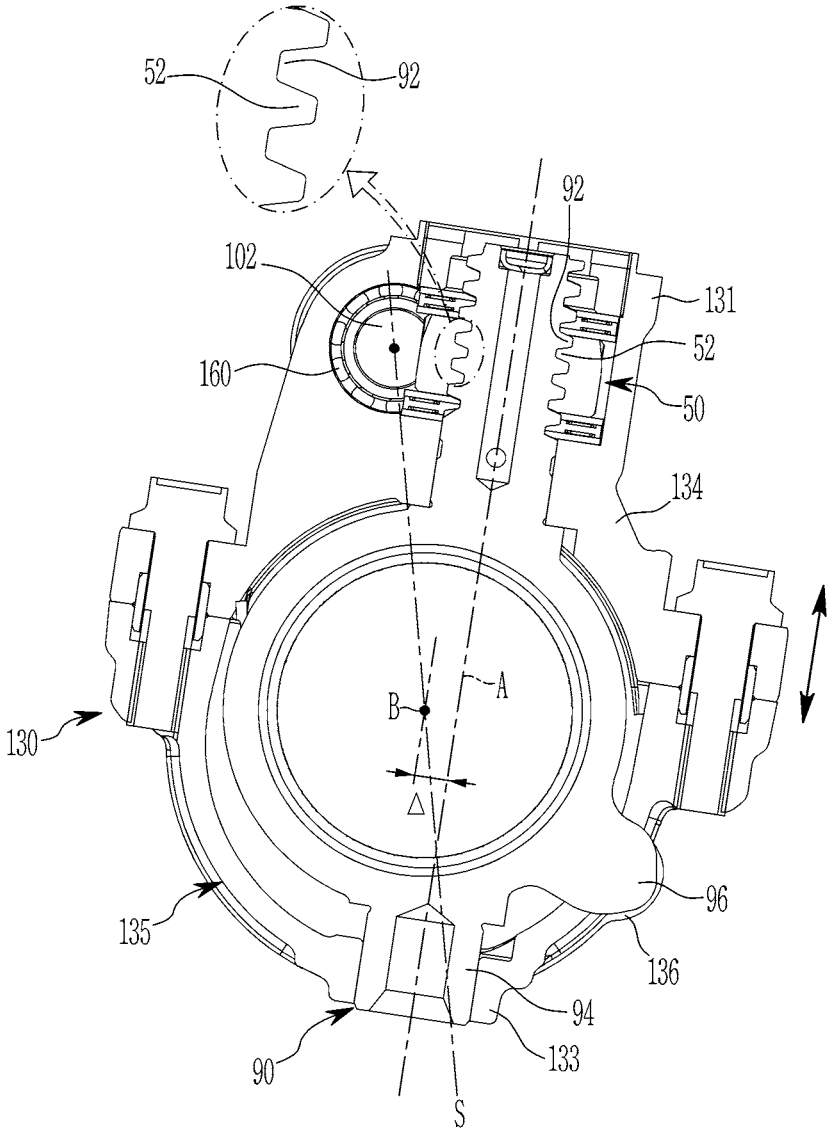
FIG. 5 is a cross-sectional view along line V-V of FIG. 1.
Figure 6:
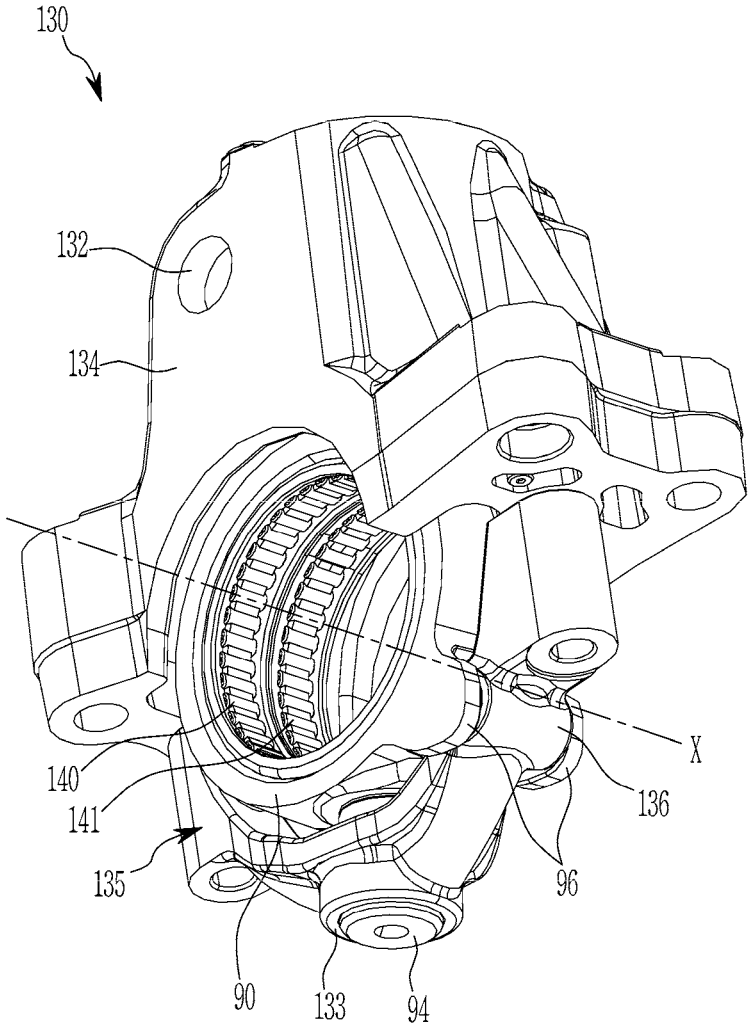
FIG. 6 is a perspective view of a guide bracket applied to a continuous variable valve duration apparatus according to an exemplary embodiment of the present disclosure.

FIG. 5 is a cross-sectional view along line V-V of FIG. 1, and FIG. 6 is a perspective view of a guide bracket applied to a continuous variable valve duration apparatus according to an exemplary embodiment of the present disclosure.

Referring to FIG. 1 to FIG. 6, an engine 1 according to an exemplary embodiment of the present disclosure includes a cylinder head 3 and an engine block 5, and a continuous variable valve duration apparatus according to an exemplary embodiment of the present disclosure is mounted on the cylinder head 3.

In the drawings, 4 cylinders 211, 212, 213 and 214 are formed to the engine, but it is not limited thereto.

A continuous variable valve duration apparatus according to an exemplary embodiment of the present disclosure may include a camshaft 30, a cam unit 70 on which a cam 71 is formed and the camshaft 30 is inserted into the cam unit 70, a guide bracket 130 of which an upper guide boss 131 is formed thereto, an inner wheel 80 transmitting the rotation of the camshaft 30 to the cam unit 70, a wheel housing 90 of which a guide shaft 91 having a guide thread 92 formed thereon to be movably inserted into the upper guide boss 131 is formed thereto, and of which a tail guide 96 guiding the relative movement of the guide bracket 130 is formed thereto, and the wheel housing 90 into which the inner wheel 80 is rotatably inserted, a worm wheel 50 of which an inner thread 52 engaged with the guide thread 92 is formed on an inside thereof and of which an outer thread 54 is formed on an outside thereof, and a control shaft 102 of which a control worm 104 engaged with the outer thread 54 is formed thereon.

The camshaft 30 may be an intake camshaft or an exhaust camshaft.

A control shaft hole 132 supporting the control shaft 102 is formed in the guide bracket 130, and a control shaft bearing 160 is mounted in the control shaft hole 132 to support rotation of the control shaft 102.

A thrust bearing 150 is mounted on the upper guide boss 131 to support the worm wheel 50, and as shown in the drawing, the thrust bearing 150 may be mounted above and below the worm wheel 50, respectively.

A worm cap 152 may be connected to the guide bracket 130 to support the thrust bearing 150, for example, the worm cap 152 may be connected to the guide bracket 130 by caulking.

A worm cap cover 153 is mounted on the worm cap 152 to prevent foreign substances from entering the worm cap 152.

The inner thread 52 and the guide thread 92 of the worm wheel 50 may be trapezoidal threads.

The thrust bearing 150 allows the worm wheel 50 to rotate smoothly, and the worm cap 152 fixes the position of the worm wheel 50.

Accordingly, the worm wheel 50 is mounted at a fixed position of the guide bracket 130, and the wheel housing 90 may move smoothly in the vertical direction of drawing according to the rotation of the worm wheel 50.

Figure 7:
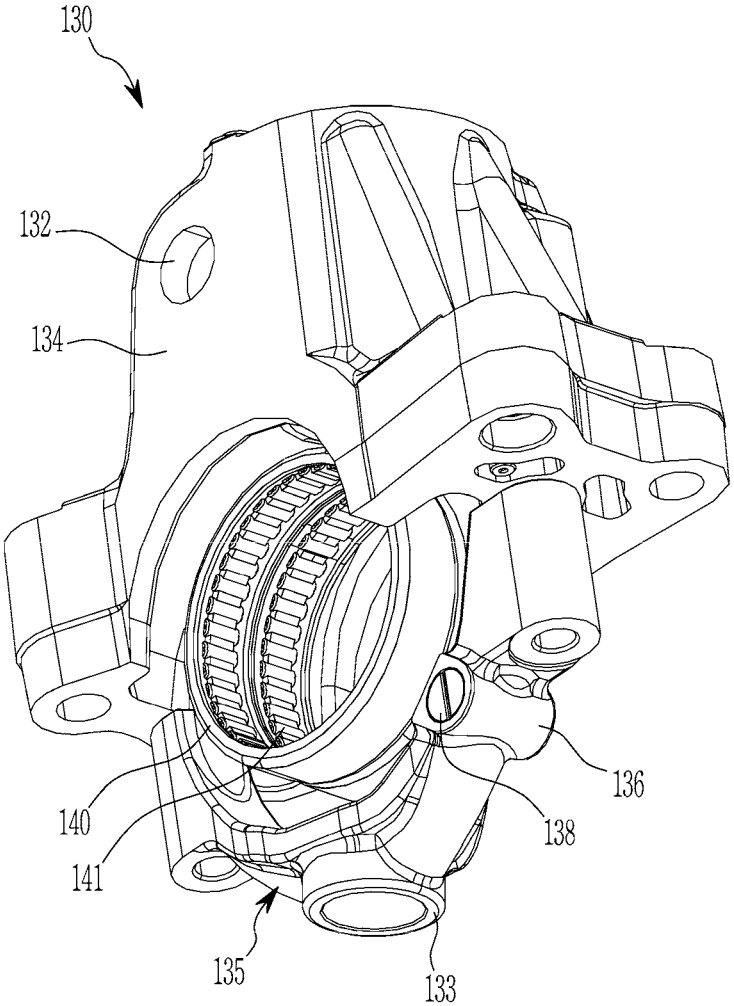
FIG. 7 is a drawing excluding a wheel housing in FIG. 6.
Figure 8:
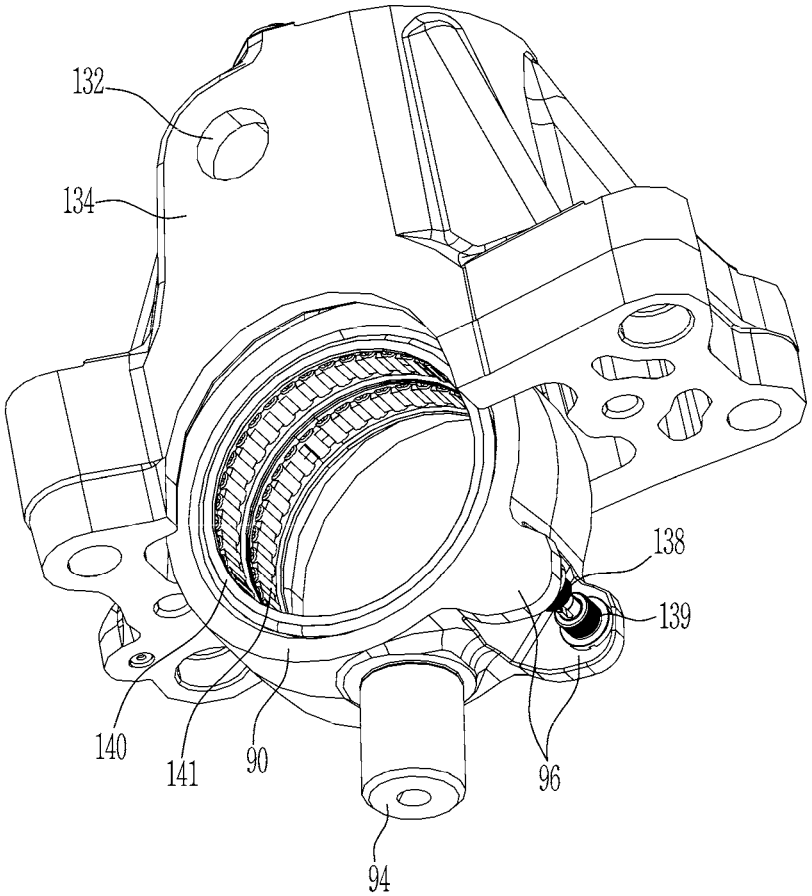
FIG. 8 is a drawing excluding a lower guide bracket in FIG. 7.

FIG. 7 is a drawing excluding a wheel housing in FIG. 6, and FIG. 8 is a drawing excluding a lower guide bracket in FIG. 7.

Figure 9:
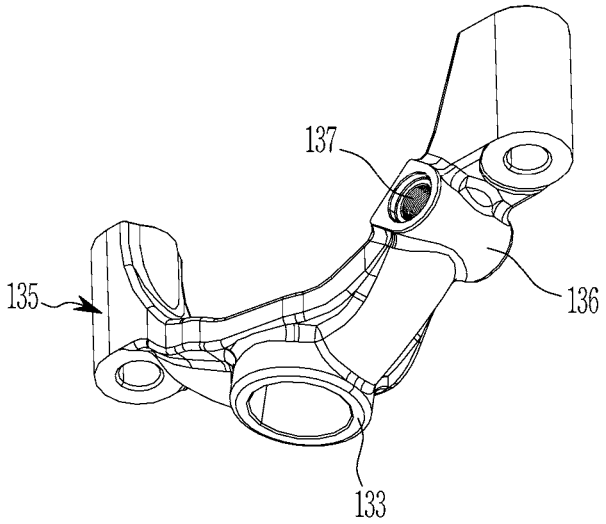
FIG. 9 is a perspective view of a lower guide bracket that may be applied to the continuous variable valve duration apparatus according to an exemplary embodiment of the present disclosure.

FIG. 9 is a perspective view of a lower guide bracket that may be applied to the continuous variable valve duration apparatus according to an exemplary embodiment of the present disclosure.

Referring to FIG. 6 to FIG. 9, the tail guide 96 may be protruded to wrap around the guide bracket 130.

The guide bracket 130 may include an upper guide bracket 134 of which the upper guide boss 131 into which the guide shaft 91 is inserted is formed thereto, and a lower guide bracket 135 of which a lower guide boss 133 is formed thereto, and connected with the upper guide bracket 134.

The tail guide 96 may be protruded outwardly of the lower guide bracket 135 to guide movement of the lower guide bracket 135.

The wheel housing 90 may include a guide rod 94 formed protruded to be inserted into the lower guide boss 133.

The guide rod 94 inserted into the lower guide boss 133 guides the movement of the guide bracket 130 when the guide bracket 130 moves and may prevent the guide bracket 130 from shaking.

The lower guide bracket 135 may include a tolerance adjusting portion 136 formed at a position corresponding to the tail guide 96 and a tolerance adjusting pin 138 and 139 inserted into the tolerance adjusting portion.

The tail guide 96 is formed in pairs in symmetrical positions to surround the guide bracket 130, and the tolerance adjusting pin 138, and 139 may be mounted in pairs in corresponding positions on each of the tail guide 96.

An adjusting thread 137 is formed inside the tolerance adjusting portion 136, and the tolerance adjusting pins 138 and 139 may be screwed to the adjusting thread 137.

The tolerance adjusting pins 138, and 139 are screwed onto the adjusting thread 137, and rotating the tolerance adjusting pin 138, and 139 allows the tolerance adjusting pin 138, and 139 to protrude or move inward along the adjusting thread 137.

That is, by rotating the tolerance adjusting pins 138, and 139, the protrude degree of the tolerance adjusting pins 138, and 139 may be adjusted to adjust the gap with the tail guide 96.

For example, the protrude degree of the tolerance adjusting pin 138, and 139 along the X axis direction of FIG. 6 may be adjusted.

Although the drawing shows that the tolerance adjusting pins 138 and 139 are provided in pairs, but is not limited thereto, and one or a plurality of tolerance adjusting pins may be applied.

The continuous variable valve duration apparatus is manufactured by assembling a plurality of parts, and there may be differences in the assemble quality depending on the production status of each part, and various tolerances of the finished product may occur due to the accumulation of fine tolerances of each part, and thus noise and vibration may occur.

In particular, when the tolerance between the wheel housing and the guide bracket is considerable, noise and vibration may occur due to the vibration of the wheel housing.

However, the continuous variable valve duration apparatus according to an exemplary embodiment of the present disclosure adjusts the protrude degree of the tolerance adjusting pin 138, and 139, even if the tolerance of the wheel housing 90 and the guide bracket 130 occurs, so that and the gap to the tail guide 96 may be adjusted.

Accordingly, the tolerance adjusting pins 138, and 139 guide the movement of the wheel housing 90, and adjust the tolerance between the wheel housing 90 and the guide bracket 130 to suppress noise and vibration.

Referring to FIG. 5, a center B of the inner wheel 80 may be deviated from the imaginary line A connecting the upper guide boss 131 and the lower guide boss 133.

The camshaft 30 and the control shaft 102 can be mounted on a virtual vertical line S.

Therefore, it is possible to prevent tool interference when engaging the cam cap with bolts.

Here, the virtual vertical line S phase does not mean that it is on a completely vertical line, but it is a practical vertical line (substantially vertical) phase, which means a configuration capable of minimizing interference when working through a tool.

The center B of the inner wheel 80 is offset (A) with the imaginary line A connecting the upper guide boss 131 and the lower guide boss 133, so even if a slight slope is given to the valve duration apparatus, the camshaft 30 and the control shaft 102 can be mounted on the virtual vertical line S.

Figure 10:
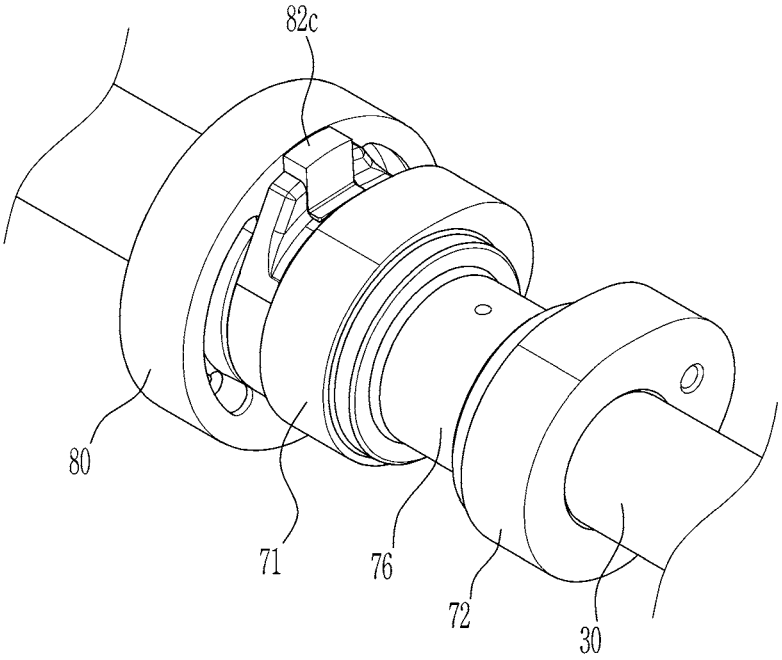
FIG. 10 is a perspective view showing an inner wheel and a cam unit applied to the continuous variable valve duration apparatus according to an exemplary embodiment of the present disclosure.
Figure 11:
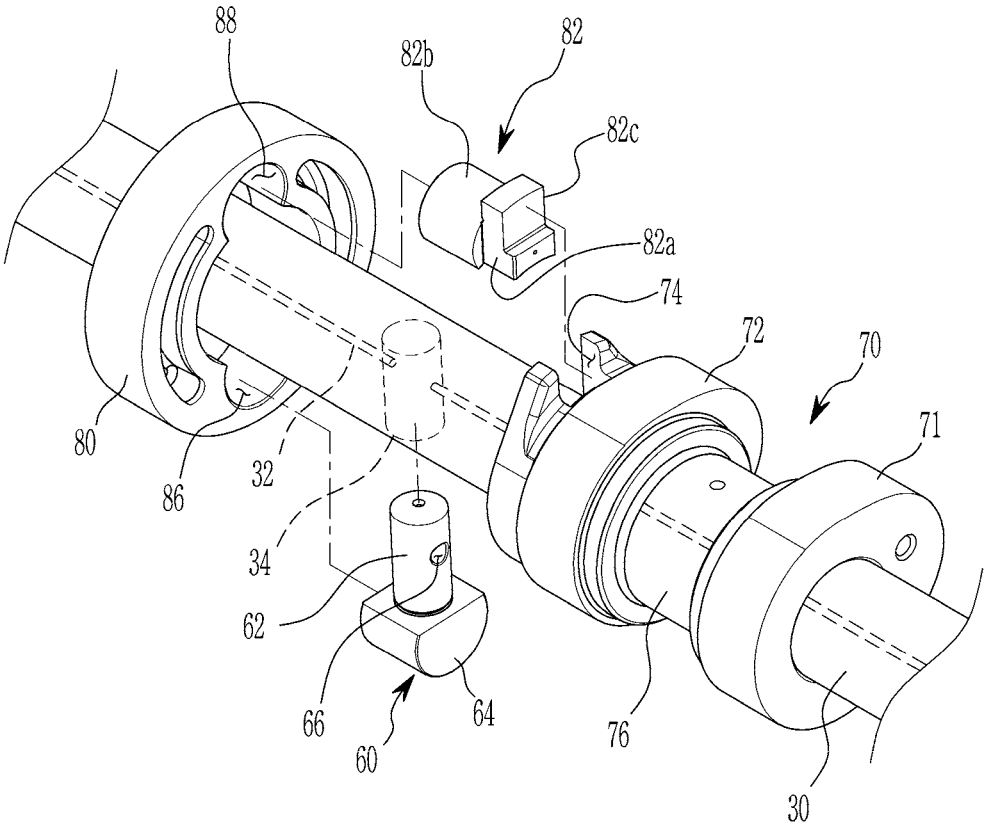
FIG. 11 is an exploded perspective view showing an inner wheel and a cam unit applied to the continuous variable valve duration apparatus according to an exemplary embodiment of the present disclosure.

FIG. 10 is a perspective view showing an inner wheel and cam unit applied to the continuous variable valve duration apparatus according to an exemplary embodiment of the present disclosure, and FIG. 11 is an exploded perspective view showing an inner wheel and a cam unit applied to the continuous variable valve duration apparatus according to an exemplary embodiment of the present disclosure.

Referring to FIG. 1 to FIG. 11, first and second sliding holes 86 and 88 are formed to the inner wheel 80, and a cam slot 74 is formed to the cam unit 70.

The continuous variable valve duration apparatus further includes a roller wheel 60 connected to the camshaft 30 and rotatably inserted into the first sliding hole 86 and a roller cam 82 slidably inserted into the cam slot 74 and rotatably inserted into the second sliding hole 88.

The roller cam 82 includes a roller cam body 82*a* slidably inserted into the cam slot 74 and a cam head 82*b* rotatably inserted into the second sliding hole 88.

A protrusion 82*c* is formed at the roller cam 82 for preventing the roller cam 82 from being separated from the inner wheel 80 along the longitudinal direction of the camshaft 30.

The roller wheel 60 includes a wheel body 62 slidably connected to the camshaft 30 and a wheel head 64 rotatably inserted into the first sliding hole 86 and the wheel body 62 and the wheel head 64 may be integrally formed.

A camshaft hole 34 is formed to the camshaft 30, the wheel body 62 of the roller wheel 60 is movably inserted into the camshaft hole 34 and the wheel head 64 is rotatably inserted into the first sliding hole 86.

A camshaft oil hole 32 is formed within the camshaft 30 along a longitudinal direction thereof, a body oil hole 66 communicated with the camshaft oil hole 32 is formed to the wheel body 62 of the roller wheel 60 and an oil groove 68 (referring to FIG. 14) communicated with the body oil hole 66 is formed to the wheel head 64 of the roller wheel 60.

Lubricant supplied to the camshaft oil hole 32 may be supplied to the inner wheel 80 through the body oil hole 66, the communicate hole 69 and the oil groove 68.

Figure 12:
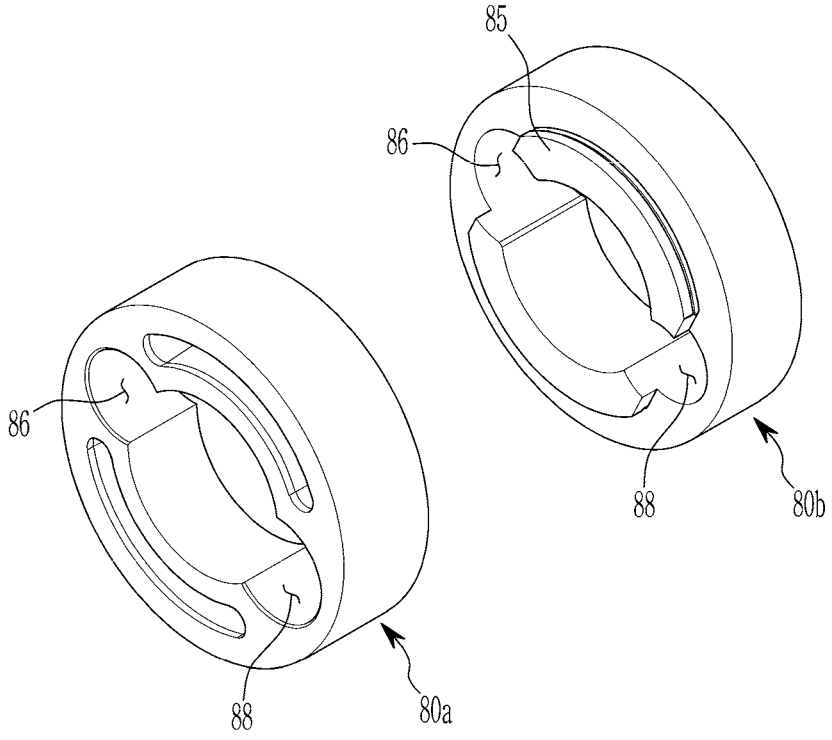
FIG. 12 is an exploded perspective view of an inner wheel of the continuous variable valve duration apparatus according to an exemplary embodiment of the present disclosure.
Figure 13:
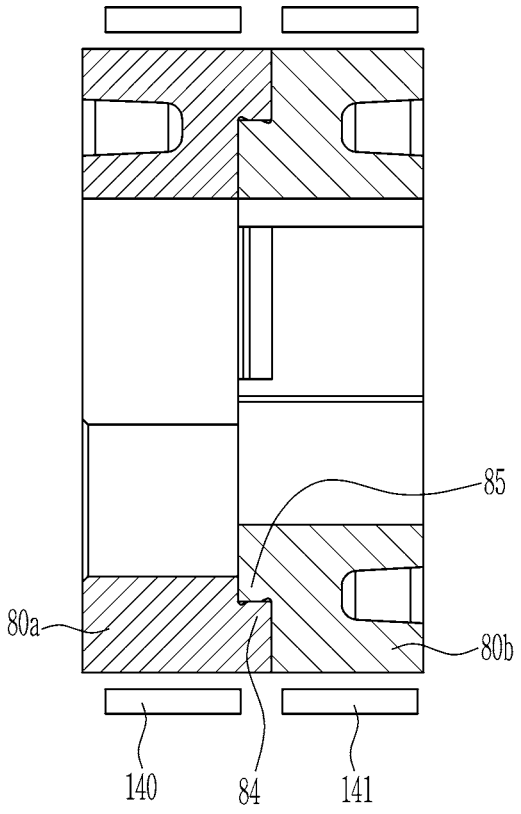
FIG. 13 is a cross-sectional view of an inner wheel of a continuous variable valve duration apparatus according to an exemplary embodiment of the present disclosure.

FIG. 12 is an exploded perspective view of an inner wheel of the continuous variable valve duration apparatus according to an exemplary embodiment of the present disclosure, and FIG. 13 is a cross-sectional view of an inner wheel of a continuous variable valve duration apparatus according to an exemplary embodiment of the present disclosure.

Referring to FIG. 2, FIG. 12 and FIG. 13, the cam unit 70 includes a first cam portion 70*a* and a second cam portion 70*b* which are disposed corresponding to a cylinder and an adjacent cylinder respectively, for example the first cylinder 201 and the adjacent second cylinder 202 and the inner wheel 80 includes a first inner wheel 80*a* and a second inner wheel 80*b* transmitting rotation of the camshaft 30 to the first cam portion 70*a* and the second cam portion 70*b* respectively.

The continuous variable valve duration apparatus further includes first and second bearings 140, and 141*a* disposed within the wheel housing 90 for supporting the first inner wheel 80*a* and the second inner wheel 80*b*.

The first and second bearings 140, and 141*a* may be a needle bearing, the first and the second inner wheels 80*a* and 80*b* are disposed within one wheel housing 90 and the first and second bearings 140, and 141*a* may rotatably support the first and the second inner wheels 80*a* and 80*b*.

Since the first and the second inner wheels 80*a* and 80*b* may be disposed within one wheel housing 90, element numbers may be reduced, so that productivity and manufacturing economy may be enhanced.

The first inner wheel 80*a* and the second inner wheel 80*b* within the wheel housing 90 may be connected rotatable to each other.

For example, a first inner wheel connecting portion 84 and a second inner wheel connecting portion 85 are formed to the first inner wheel 80*a* and the second inner wheel 80*b* respectively, and the first inner wheel connecting portion 84 and the second inner wheel connecting portion 85 are connected to each other.

In the drawing, the first inner wheel connecting portion 84 and the second inner wheel connecting portion 85 are formed as convex and concave, it is not limited thereto. The first inner wheel 80*a* and the second inner wheel 80*b* are connected rotatable to each other with variable connecting structures.

In the case that the first inner wheel 80*a* and the second inner wheel 80*b* are connected, looseness or vibration due to manufacturing tolerances of the bearing, the inner wheel, the lifter and so on may be reduced.

Two cams 71 and 72 may be formed on the first and the second cam portions 70*a* and 70*b* as a pair and a cam cap connecting portion 76 is formed between the paired cams 71 and 72 of each of the first and second cam portions 70*a* and 70*b*.

The cam 71 and 72 rotate and open the valve 200.

Figure 14:
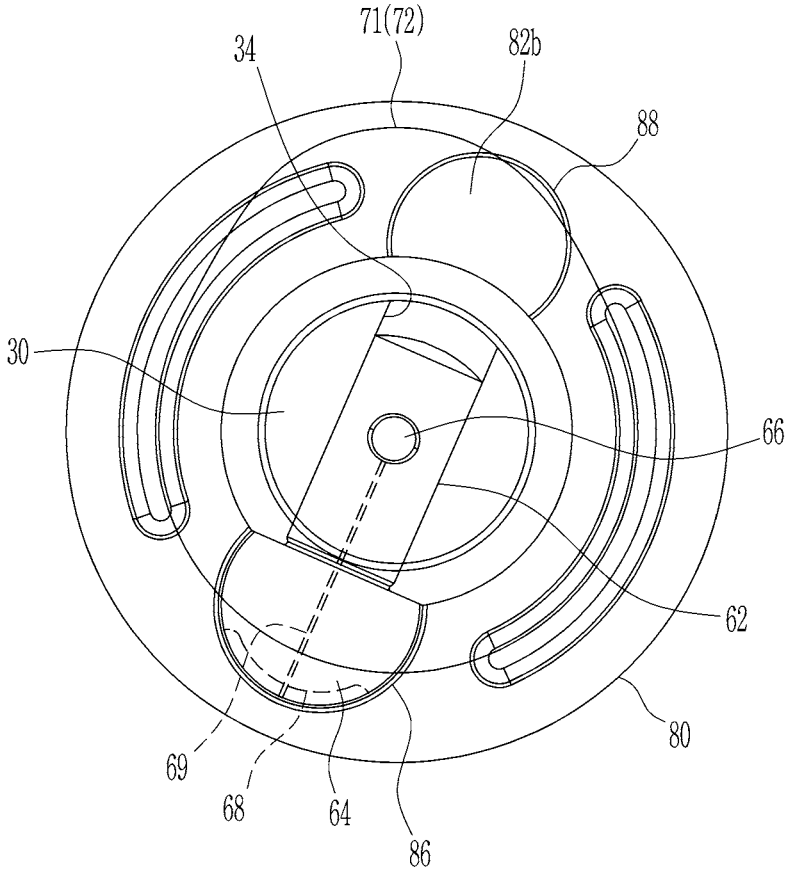
FIGS. 14, 15, and 16 are drawings illustrating an operation of a continuous variable valve duration apparatus according to an exemplary embodiment of the present disclosure.
Figure 15:
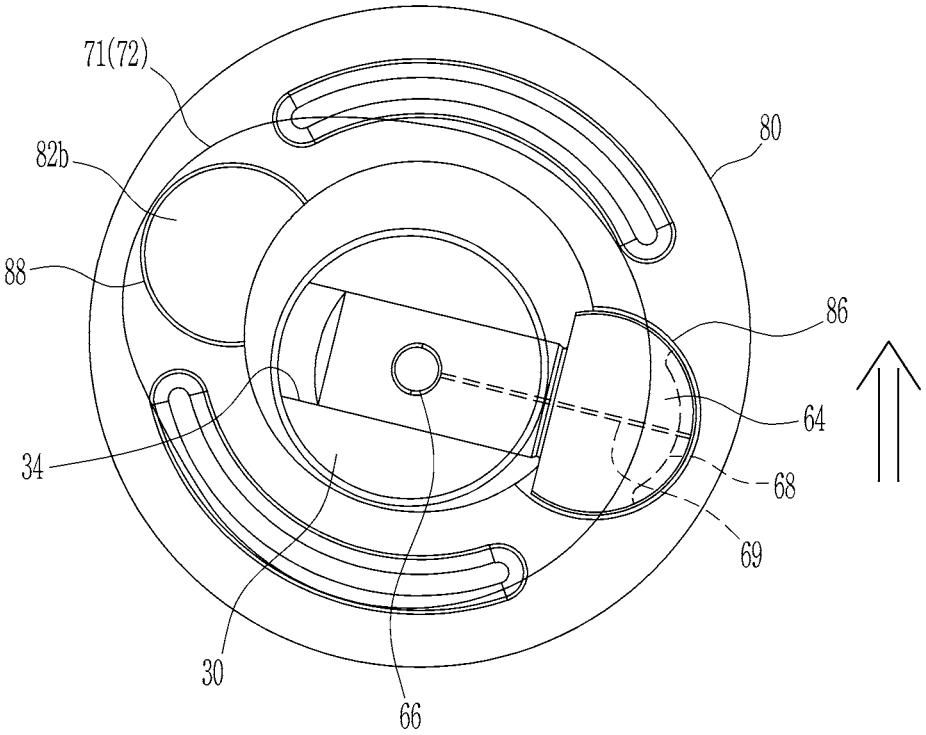
Figure 16:
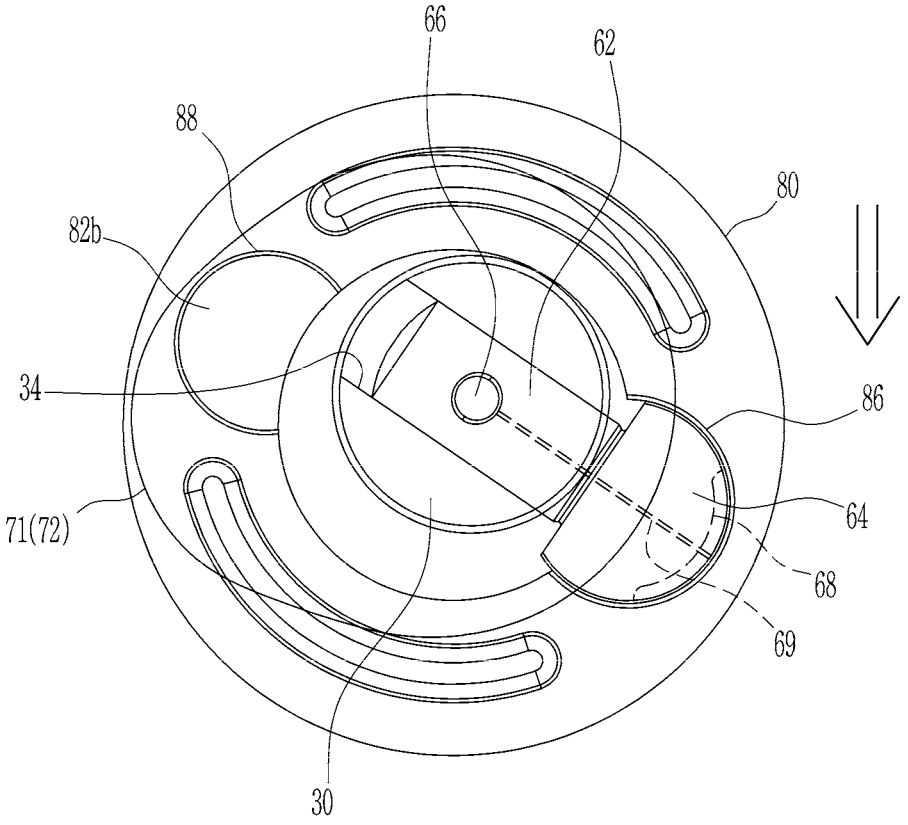

FIG. 14 to FIG. 16 are drawings illustrating an operation of a continuous variable valve duration apparatus according to an exemplary embodiment of the present disclosure.

As shown in FIG. 14, when rotation centers of the camshaft 30 and the cam unit 70 are coincident, the cams 71 and 72 rotate with the same phase angle of the camshaft 30.

According to engine operation states, an ECU (engine control unit or electric control unit) transmits control signals to the control portion 100, and then the control motor 106 rotates the control shaft 102.

Referring to FIG. 5, FIG. 15 and FIG. 16, the control worm 104 engaged with the outer thread 54 rotates the worm wheel 50. And since the inner thread 52 formed to the worm wheel 50 is engaged with the guide thread 130 and thus the worm wheel 50 moves along the guide thread 130.

That is, the worm wheel 50 rotates by the rotation of the control shaft 102 and changes the relative position of the wheel housing 90 to the camshaft 30.

When the position of the wheel housing 90 moves upper or lower relative to the rotation center of the camshaft 30, the relative rotation speed of the cams 71 and 72 with respect to the rotation speed of the camshaft 30 are changed.

While the slider pin 60 is rotated together with the camshaft 30, the pin body 62 is slidable within the camshaft hole 34, the pin head 64 is rotatable within the first sliding hole 86, and the roller cam 82 is rotatably within the second sliding hole 88 and slidable within the cam slot 74. Thus, the relative rotation speed of the cams 71 and 72 with respect to the rotation speed of the camshaft 30 is changed.

Figure 17A:
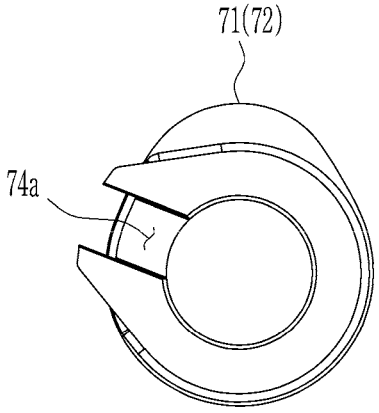
FIG. 17A and FIG. 17B are a drawing showing a cam slot of a continuous variable valve duration apparatus according to an exemplary embodiment of the present disclosure.
Figure 17B:
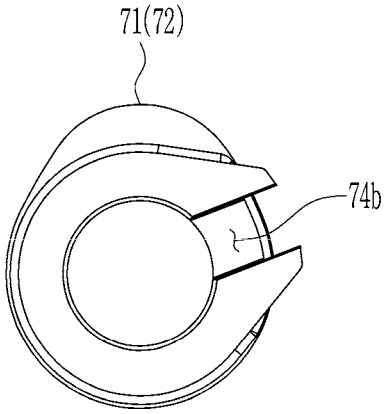
Figure 18A:
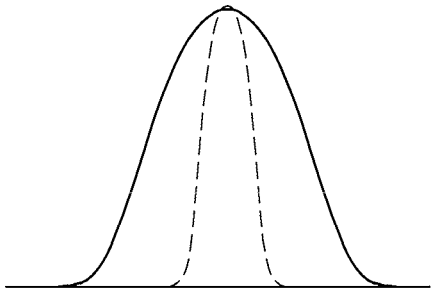
FIG. 18A, FIG. 18B and FIG. 18C are a graphs showing valve profile of a continuous variable valve duration apparatus according to an exemplary embodiment of the present disclosure.
Figure 18B:
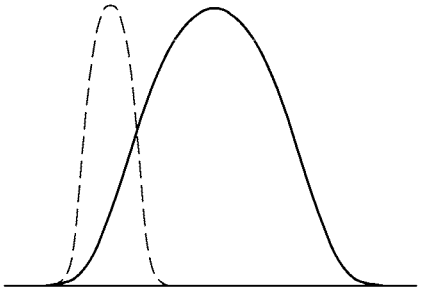
Figure 18C:
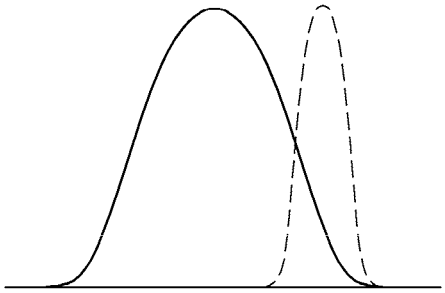

FIG. 17A and FIG. 17B are a drawing showing a cam slot of a continuous variable valve duration apparatus according to an exemplary embodiment of the present disclosure, and FIG. 18A, FIG. 18B and FIG. 18C are a graphs showing valve profile of a continuous variable valve duration apparatus according to an exemplary embodiment of the present disclosure.

As shown in FIG. 17A and FIG. 17B, the cam slot 74 may be formed more retarded than a position of the cam 71 or 72 (referring to FIG. 17A) or the cam slot 74 may be formed more advanced than a position of the cam 71 or 72 (referring to FIG. 17B), or the cam slot 74 may be formed with the same phase of the cam 71 or 72. With the above scheme, various valve profiles may be achieved.

Although maximum lift of the valve 200 is constant, however rotation speed of the cam 71 and 72 with respect to the rotation speed of the camshaft 30 is changed according to relative positions of the slider housing 90 so that closing and opening time of the valve 200 is changed. That is, duration of the valve 200 is changed.

According to the relative position of the cam slot 74, mounting angle of the valve 200 and so on, opening and closing time of the valve may be simultaneously changed as shown in FIG. 18A.

While opening time of the valve 200 is constant, closing time of the valve 200 may be retarded or advanced as shown FIG. 18B.

While closing time of the valve 200 is constant, opening time of the valve 200 may be retarded or advanced as shown FIG. 18C.

The opening profile of the valve 200 shown in FIG. 18A to FIG. 18C are examples, and various types of valve duration profiles may be formed according to the formation direction of the cam slot 74, the mount angle of the valve 200, and the like.

According to the continuous variable valve duration apparatus according to an exemplary embodiment of the present disclosure as described above, it is possible to implement various durations of the valve lift, and it is possible to reduce the noise and vibration because the tolerance control is easy.

In addition, the composition of the continuous variable valve duration apparatus is relatively small, so the entire height of the valve train may be kept relatively low.

In addition, since a continuous variable valve duration apparatus may be applied without excessive design changes of the existing general engine, productivity may be increased and production cost may be reduced.

A continuous variable valve duration apparatus according to an exemplary embodiment of the present disclosure may reduce the number of parts by applying a worm wheel, and may reduce vibration and noise.

While this disclosure has been described in connection with what is presently considered to be practical exemplary embodiments, it is to be understood that the disclosure is not limited to the disclosed embodiments. On the contrary, it is intended to cover various modifications and equivalent arrangements included within the spirit and scope of the appended claims.

The invention claimed is:

1. A continuous variable valve duration apparatus comprising:

a camshaft;

a cam unit on which a cam is formed, and the camshaft is inserted into the cam unit;

a guide bracket including an upper guide boss;

an inner wheel configured to transmit rotation of the camshaft to the cam unit;

a wheel housing including a guide shaft having a guide thread, the guide shaft being configured to be movably inserted into the upper guide boss, and the wheel housing further including a tail guide configured to guide relative movement of the guide bracket, and wherein the inner wheel is rotatably inserted into the wheel housing;

a worm wheel having an inner thread formed on an inside of the worm wheel, wherein the inner thread is configured to engage with the guide thread, and having an outer thread formed on an outside of the worm wheel;

a control shaft having a control worm engaged with the outer thread;

a tolerance adjusting portion formed to the guide bracket at a position corresponding to the tail guide; and a tolerance adjusting pin inserted into the tolerance adjusting portion.

2. The continuous variable valve duration apparatus of claim 1, wherein the tail guide is configured to protrude and wrap around the guide bracket.

3. The continuous variable valve duration apparatus of claim 2, wherein the guide bracket comprises:

an upper guide bracket of which the upper guide boss into which the guide shaft is inserted is formed thereto; and a lower guide bracket of which a lower guide boss is formed thereto, and connected with the upper guide bracket; and wherein the wheel housing comprises a guide rod configured to be inserted into the lower guide boss.

4. The continuous variable valve duration apparatus of claim 3, wherein the tolerance adjusting portion is formed on the lower guide bracket.

5. The continuous variable valve duration apparatus of claim 4, wherein:

the tail guide comprises a plurality of tail guides formed in symmetrical positions to surround the guide bracket; and the tolerance adjusting pin comprises a plurality of tolerance adjusting pins positioned on each of the tail guides.

6. The continuous variable valve duration apparatus of claim 1, further comprising a thrust bearing mounted on the upper guide boss configured to support the worm wheel.

7. The continuous variable valve duration apparatus of claim 6, further comprising a worm cap connected to the guide bracket configured to support the thrust bearing.

8. The continuous variable valve duration apparatus of claim 1, wherein a control shaft hole supporting the control shaft is formed in the guide bracket.

9. The continuous variable valve duration apparatus of claim 8, further comprising a control shaft bearing mounted in the control shaft hole to support rotation of the control shaft.

10. The continuous variable valve duration apparatus of claim 1, wherein the inner thread and the guide thread of the worm wheel comprises trapezoidal threads.

11. The continuous variable valve duration apparatus of claim 1, wherein:

first and second sliding holes are formed in the inner wheel;

a cam slot is formed in the cam unit; and wherein the continuous variable valve duration apparatus further comprises:

a roller wheel connected to the camshaft and rotatably inserted into the first sliding hole; and a roller cam slidably inserted into the cam slot and rotatably inserted into the second sliding hole.

12. The continuous variable valve duration apparatus of claim 11, wherein the roller cam comprises:

a roller cam body slidably inserted into the cam slot;

a cam head rotatably inserted into the second sliding hole; and a protrusion configured to prevent the roller cam from being removed.

13. The continuous variable valve duration apparatus of claim 12, wherein the roller wheel comprises:

a wheel body slidably connected to the camshaft; and a wheel head rotatably inserted into the first sliding hole.

14. The continuous variable valve duration apparatus of claim 13, further comprising:

a camshaft oil hole formed within the camshaft along a longitudinal direction;

a body oil hole formed to the wheel body of the roller wheel and configured to communicate with the camshaft oil hole; and an oil groove positioned on the wheel head of the roller wheel and configured to communicate with the body oil hole.

15. The continuous variable valve duration apparatus of claim 1, wherein:

the cam unit includes a first cam portion corresponding to a first cylinder and a second cam portion corresponding to a second cylinder; and the inner wheel includes a first inner wheel configured to transmit the rotation of the camshaft to the first cam portion and a second inner wheel configured to transmit the rotation of the camshaft to the second cam portion.

16. The continuous variable valve duration apparatus of claim 15, wherein the first inner wheel and the second inner wheel are rotatably connected.

17. The continuous variable valve duration apparatus of claim 16, further comprising a first bearing positioned within the wheel housing configured to support the first inner wheel, and a second bearing positioned within the wheel housing configured to support the second inner wheel.

18. An engine provided with the continuous variable valve duration apparatus of claim 1.

* * * * *